United States Patent [19]

Chion et al.

[11] 4,052,550

[45] Oct. 4, 1977

[54] POLY(VINYLIDENE FLUORIDE) YARNS AND FIBERS

[75] Inventors: Pierre Chion, Bron; Robert Cuidard, Ecully, both of France

[73] Assignee: Rhone-Poulenc-Textile, France

[21] Appl. No.: 653,654

[22] Filed: Jan. 29, 1976

Related U.S. Application Data

[62] Division of Ser. No. 474,585, May 30, 1974, Pat. No. 3,965,232.

[30] Foreign Application Priority Data

June 6, 1973 France ..... 73.20666

[51] Int. Cl.[2] ..... C08F 14/22; C08F 114/22

[52] U.S. Cl. ..... 526/255; 260/30.4 R; 260/32.6 R

[58] Field of Search ..... 526/255

[56] References Cited

U.S. PATENT DOCUMENTS

| | | | |
|---|---|---|---|
| 3,553,185 | 1/1971 | Amagi et al. | 526/255 |
| 3,707,592 | 12/1972 | Ishii et al. | 526/255 |
| 3,925,339 | 12/1975 | Ishii et al. | 526/255 |

*Primary Examiner*—Harry Wong, Jr.

*Attorney, Agent, or Firm*—Stevens, Davis, Miller & Mosher

[57] ABSTRACT

A process of making polyvinylidene fluoride yarns and fibers of homogeneous structure and good dry strength includes the steps of spinning the solution of the polymer into a coagulating bath containing 45 to 60% by weight aprotic polar organic solvent and 40 to 55% by weight water, stretching the filaments in air to a ratio of 1.5 to 5x and then in boiling water to a ratio of 1.5 to 4x (overall stretching ratio of 3x to 6.5x) and then washing in water at room temperature.

3 Claims, No Drawings

POLY(VINYLIDENE FLUORIDE) YARNS AND FIBERS

This is a division of application Ser. No. 474,585, filed May 30, 1974, now U.S. Pat. No. 3,965,232.

The present invention relates to a new process for the obtaining of bright yarns and fibers having a base of polyvinylidene fluoride and having good mechanical properties. More particularly, the invention relates to yarns or fibers of excellent dry tenacity and improved structure.

It is already known from French Patent 1,390,552 to obtain polyvinylidene fluoride yarns by wet spinning in a bath containing a mixture of an amide and a ketone, maintained at a temperature of 37.8° to 57.2° C, the filaments being then in succession dried in air and then under tension, washed, twisted, possibly dried under vacuum, and then stretched in a ratio of 3 to 10 at a temperature of 121° to 204° C.

However, the filaments obtained in this manner have dry strengths which do not exceed 3.0 to 3.5 grams/-denier (27 to 32 grams/tex) and an elongation upon rupture of 12 to 22%.

There has now been discovered, and this constitutes the object of the present invention, a process for the obtaining of polyvinylidene (vinylidene fluoride) yarns and fibers of improved structure and a dry strength of more than 33 grams/tex, characterized by spinning a solution of polymer into a coagulating bath containing 45 to 60% by weight polar organic solvent and 40 to 55% by weight water, maintained between 15 and 40° C, stretching the filaments in air at a rate of 1.5 to 5×, thereupon stretching them in boiling water at a rate of 1.5 to 4×, the overall rate of stretching being from 3 to 6.5×, then washing them with water at room temperature in the customary manner. They may possibly be stretched again at a rate of 1.15 to 1.40× at a temperature between 140° and 160° C and/or subjected to some other heat treatment such as a stabilization at a temperature of between 140° and 160° C.

The present invention also covers all the textile articles obtained from these fibers or yarns.

By poly (vinylidene fluoride) yarns or fibers there are understood homopolymers of vinylidene fluoride and copolymers containing at least 95% by weight vinylidene fluoride and up to 5% by weight of one or more other monomers which are copolymerizable with vinylidene fluoride, such as fluorinated monomers.

The poly (vinylidene fluoride) used in the process of the present invention should have a fluidity index at 250° C of at least 10 and preferably between 100 and 5,000. This index represents the amount of polymer in mg extruded in one minute through a nozzle of a diameter of 2 mm under a head of 10 Kg/cm$^2$.

The polymer thus defined is dissolved in an aprotic polar organic solvent such as dimethylformamide, dimethylacetamide, N-methylpyrrolidone, etc.

The viscosity of the solution is generally between 100 and 500 poises.

The spinning solution which has been prepared in this manner is extruded through a spinneret immersed in a coagulating bath formed of 45 to 60% by weight of the same polar organic solvent as used in the polymer solution (preferably dimethylformamide or dimethylacetamide) and 55 to 40% by weight of water. Below 45% solvent, the yarns obtained are dull and have a porous structure. Above 60% the coagulation takes place poorly and the yarns are too soft to be taken up under normal conditions and assume a dull appearance. On the other hand, the preferred contents of 45 to 60% solvent make it possible to obtain bright filaments of good mechanical properties and are necessary in order to obtain these properties. The temperature of the bath may vary but it is generally preferred to spin at temperatures between 15° and 40° C.

The filaments are then stretched in air at room temperature, that is to say temperatures generally between 15° and 40° C, for instance by passage between 2 pairs of rollers whose speeds are adjusted in such a manner as to impart a stretch ratio of between 1.5× and 5× to the filaments. The stretching in air is preferably effected to a ratio of the order of 3 or 4×, which leads to an additional improvement in the structure of the filaments. The filaments then undergo a second stretching in boiling water in accordance with any means known to the man skilled in the art to a ratio of between 1.5× and 4×, this ratio being selected in such a manner that the overall stretch ratio is between 3× and 6.5×.

The filaments are then washed in customary fashion, generally at room temperature and preferably in water for obvious reasons of economy, and preferably, in counter current in order to obtain maximum efficiency. If desired, other treatments can be carried out which are optional within the scope of the invention, such as stabilization at elevated temperature, for instance between 140° and 160° C, by any known method.

The filaments may also be subjected to overstretching in a slower ratio, for instance between 1.15× and 1.40× at elevated temperature, for instance between 140° and 160° C, by any means known to the man skilled in the art. The over-stretching makes it possible further to improve the dry strength which may then reach values of 50 grams/tex, for instance, or even more.

However, it is both the linking formed by the spinning, the double stretching, and the washing as well as the precise proportions (45 to 60%) of polar organic solvent in the coagulating bath which make it possible to obtain yarns of excellent mechanical properties, in particular of a dry strength of at least 33 grams/tex and of excellent structure. In particular the filaments obtained in this manner have a very shiny appearance due to a homogeneous structure, which structure can be shown by the secondary swelling values of the yarns. The secondary swelling represents the absorption power of the fibers, that is to say their porosity. In order for fibers to be homogeneous, their secondary swelling should generally not exceed 20%, preferably 15%. The measurement of the secondary swelling is effected in the following fashion:

The fibers to be tested are wetted by immersing in demineralized water for 3 hours. The wetted fibers are centrifuged for 10 minutes with an acceleration equal to 1,000 times that of gravity. They are then weighed and then dried at 105° C for 2 hours. The dry fibers are weighed and by difference one notes the amount of water which was absorbed by the fibre, which amount, referred to the weight of the dry fibers, gives the secondary swelling.

The fibers obtained in accordance with the present invention are very bright and have a particularly homogeneous structure since they possess a secondary swelling rate of the order of about 5%.

Furthermore, the filaments thus obtained have very good mechanical properties and, inter alia, a dry strength greater than 33 gram/tex, with an elongation at rupture of up to 30% or even more. The yarns thus obtained are used in knitting, weaving (upholstery) in which their properties of noninflammability together with good mechanical properties are highly appreciated.

The following examples in which the parts and percentages are by weight are intended to illustrate the present invention without limiting it.

In the examples the viscosities are measured by means of an Epprecht-Rheomat apparatus.

EXAMPLE 1

A 23% solution of poly (vinylidene fluoride) of a fluidity index of 190 in dimethylformamide is prepared. This solution of a viscosity of 300 poises, heated beforehand to 60° C is spun through a spinneret having 64 orifices of a diameter of 0.07 mm into a coagulating bath maintained at 25° C, containing 57% dimethylformamide and 43% water.

Upon their emergence from the coagulating bath, the filaments are taken up at a speed of 5 m/minute and then stretched in the air at room temperature of a ratio of 3.4×. They are again stretched in boiling water of a ratio of 1.9× and then washed with water at room temperature.

The properties of the yarns obtained are as follows:

| | |
|---|---|
| count | 3.3 dtex |
| dry strength | 37 grams/tex |
| elongation at rupture | 23% |
| modulus of elasticity | 210 grams/tex |
| appearance | bright |
| secondary swelling rate | 5.4% |

EXAMPLE 2

A polymer identical to that of example 1 is spun, stretched and washed in the same way as in example 1. However, after they have been washed the filaments are stabilized at 150° C on rollers by passage at a speed of 75 m/minute, the yarns being maintained at constant length.

The filaments obtained have the following properties:

| | |
|---|---|
| count | 3.4 dtex |
| dry strength | 41 grams/tex |
| elongation at rupture | 24% |
| modulus of elasticity | 160 grams/tex |
| appearance | bright |
| secondary swelling rate | 4.7% |

EXAMPLE 3

A polymer identical to that of example 1 is spun, stretched and washed in the same way as in example 1 but after washing the filaments are over-stretched by passage over rollers heated to 150° C at a speed of 75 m/minute with a ratio of 1.26×.

The properties of the yarns are as follows:

| | |
|---|---|
| count | 3.0 dtex |
| dry strength | 48 grams/tex |
| elongation at rupture | 18% |
| modulus of elasticity | 245 grams/tex |
| appearance | bright |

EXAMPLE 4

A. The same polymer spun in the same manner as in the preceding examples is spun into a coagulating bath containing 57% dimethylformamide and 43% water, said bath being maintained at 25° C. Thereupon, the yarns are subjected to a stretching in air to a ratio of 1.86× and then to a stretching in boiling water in a ratio of 3.4× and finally to washing with water at room temperature. The results are given in the following table.

B. By way of comparative test, an identical polymer is spun in the same manner as above in a coagulating bath containing 50% dimethylformamide and 50% water, maintained at 20° C. The filaments are then subjected to stretching in air to a ratio of 1.86× and are washed with water in counter current before being stretched again in boiling water to a ratio of 3.2×.

The results of the comparative tests A and B are:

| | Test A | Test B |
|---|---|---|
| count | 220 dtex/ 64 ends | 275 dtex/ 64 ends |
| dry strength | 37 grams/tex | 29 grams/tex |
| elongation at rupture | 17% | 16% |
| appearance | bright | chalky and dull |
| secondary swelling rate | 6% | 21% |

EXAMPLE 5

A polymer identical to that of example 1 is spun and treated exactly in the same manner as in example 4A with the exception of the stretch ratios which are 3.4× in air and 1.9× in boiling water respectively.

The yarns obtained have the following properties:

| | |
|---|---|
| count | 245 dtex/64 ends |
| dry strength | 37 grams/tex |
| elongation at rupture | 21% |
| appearance | bright |
| secondary swelling rate | 5% |

EXAMPLE 6

A. A 23% solution of poly (vinylidene fluoride) dissolved in dimethylacetamide is spun into a coagulating bath at 20° C containing 40% dimethylacetamide and 60% water. The filaments are stretched in air to a ratio of 1.86×, washed in water of room temperature in counter current and stretched in boiling water to a ratio of 2.7×. The results of the yarns are set forth in the table below.

B. A solution identical to that of A is spun in the same manner as under A but using a coagulating bath containing 50% dimethylacetamide and 50% water. The filaments are stretched in air with the same ratio of 1.86× then washed and stretched in boiling water to a ratio of 3.3×. The results are set forth in the table below.

C. An identical polymer is spun in the same manner as in A and B into a coagulating bath containing 65% dimethylacetamide and 35% water, the filaments are stretched in air to a ratio of 1.86×, washed with water of room temperature, and then stretched in boiling water to a ratio of 3.2×. The results are set forth in the table below.

D. An identical polymer solution is spun into a coagulating bath maintained at 20° C containing 57% dimethylacetamide and 43% water, the filaments are stretched in air to a ratio of 3.4× and then in boiling water to a ratio of 1.9×, and then washed as described above. The results are set forth in the table below.

| Results of tests A - B - C - D | A | B | C | D |
|---|---|---|---|---|
| Yarn Number (dtex) | 310/64 ends | 280/64 ends | 285/64 ends | 235/64 ends |
| Dry Strength Grams/Tex | 16 | 28 | 23.5 | 34 |
| Elongation % | 20 | 27 | 20 | 20 |
| Appearance | chalky & dull | semi-dull | semi-dull | bright |
| Secondary Swelling % | 53 | 20 | 27 | 6 |

It is clear from these tests that in order to obtain the required tenacity and the bright appearance of the filaments two conditions are necessary, namely a solvent concentration of between 45 and 60% and the position of the washing after the two stretchings.

I claim:

1. Polyvinylidene fluoride yarns and fibers having a dry tenacity of at least 33 g/tex and an improved structure as measured by their secondary swelling values of up to 20% prepared by spinning a solution of polyvinylidene fluoride having a fluidity index at 250° C of at least 10 into a coagulating bath containing 45 to 60% by weight of an aprotic polar organic solvent and 40 to 55% by weight of water maintained at a temperature between 15° and 40° C, stretching the filaments in air at a temperature between 15° and 40° C to a ratio of between 1.5× and 5×, then stretching the filaments in boiling water to a ratio of between 1.5× and 4×, the overall stretch ratio being between 3× and 6.5×, and then washing the filaments with water maintained at a temperature between 15° C and 40° C at room temperature.

2. The yarns and fibers of claim 1 wherein said fluidity index is between 100 and 5,000.

3. The yarns and fibers of claim 1 wherein the secondary swelling value is no greater than 15%.

* * * * *